US005862673A

United States Patent [19]

Bang

[11] Patent Number: 5,862,673

[45] Date of Patent: Jan. 26, 1999

[54] OPERATIONAL CONTROL APPARATUS FOR HOME APPLIANCES AND CONTROL METHOD THEREFOR

[75] Inventor: Yong-Woong Bang, Suwon, Rep. of Korea

[73] Assignee: Samsung Electronics Co., Ltd., Suwon, Rep. of Korea

[21] Appl. No.: 850,822

[22] Filed: May 2, 1997

[30] Foreign Application Priority Data

Aug. 28, 1996 [KR] Rep. of Korea ..... 1996 36085

[51] Int. Cl.[6] ..... F25B 49/02

[52] U.S. Cl. ..... 62/158; 62/161; 361/28; 307/141

[58] Field of Search ..... 62/158, 231, 157, 62/161, 162, 163, 164; 165/270; 307/141, 141.4, 141.8; 361/22, 28, 29; 327/392, 393; 388/921

[56] References Cited

U.S. PATENT DOCUMENTS

| | | | |
|---|---|---|---|
| 3,422,633 | 1/1969 | Bodett | 62/158 |
| 3,785,165 | 1/1974 | Valenzuela, Jr. | 62/158 |
| 4,232,819 | 11/1980 | Bost | 62/158 X |
| 5,483,805 | 1/1996 | Fujii et al. | 62/158 |

*Primary Examiner*—Harry B. Tanner
*Attorney, Agent, or Firm*—Burns, Doane, Swecker & Mathis, L.L.P.

[57] ABSTRACT

A home appliance such as an air conditioner, refrigerator, television, or tape recorder, includes a drive element, a controller for controlling the drive element, and a manual input panel for enabling a user to input a drive signal for driving the drive element. A counter counts a time interval following the inputting of a drive signal to delay driving of the drive element until a predetermined time period has elapsed. If no counter signal is input driving the predetermined time period, the drive element is driven.

3 Claims, 11 Drawing Sheets

OPERATIONAL CONTROL APPARATUS FOR HOME APPLIANCES AND CONTROL METHOD THEREFOR

BACKGROUND OF THE INVENTION

1 Field of the Invention

This invention relates to home appliances such as an air conditioner, a refrigerator, a television set, a video tape recorder and the like and more particularly to an operational control apparatus of home appliances and control method therefor which can prevent driving elements of home appliances from being operated intermittently by frequent ON/OFF manipulations to thereby protect the home appliances.

2 Description of the Prior Art

As shown in FIGS. 1 and 2, an indoor unit 1 of a conventional air conditioner as an example of home appliances has an inlet grill member 5 including a plurality of inlet holes 3 through which room air is sucked and has an outlet 7 formed at a frontal upper part thereof for discharging the air heat-exchanged as cold wind or hot wind after being sucked through the inlet holes 3.

Further, there are installed across the outlet 7 horizontal blades 9 for vertically controlling a direction of the air discharged through the outlet 7 and vertical blades 11 for horizontally controlling a direction of the air. There is installed inside the outlet 7 an outlet door 13 to open the outlet 7 so that the air heat-exchanged in a heat exchanger (not shown) is provided in a room smoothly and to close the outlet 7 both for preventing dust and harmful materials from flowing into the indoor unit 1 during an operation stand-by condition and for beautifying an external appearance thereof.

A cover member 15 is fixed at a frontal part of the indoor unit 1 both for design purposes and for protecting inner elements of the apparatus; and a control panel 17 is equipped at a lower side of the cover member 15 for enabling a user to select operational modes (auto, cooling, defrosting, air blowing, heating or the like), start/stop operation, discharge amount and wind directions of the air discharged through the outlet hole 7 of the air conditioner.

As shown in FIG. 3, drive means for vertically moving the outlet door 13 includes a support member 19 fixed at a frontal upper part of the indoor unit 1, an outlet motor 21 fixed to the support member 19 for generating torque for vertically moving the outlet door 13, a pinion 23 coupled with a shaft 22 of the outlet motor 21 to be revolved by the outlet motor 21, and a rack 25 engaged with the pinion 23 to vertically move the outlet door 13 by changing revolutionary movement of the pinion 23 to linear movement of the outlet door 13 when the pinion 23 is revolved.

In addition, drive means for rotating the horizontal blades 9 comprises a wind direction control motor 27 (e.g., a stepping motor) installed inside the indoor unit 1 and a plurality of link members 29 operated by the wind direction control motor 27 to thereby rotate the plurality of horizontal blades 9 simultaneously.

In an air conditioner as constructed above, when a user selects a operational mode by manipulating a remote controller or the control panel 17 and turns on a start/stop key (hereinafter referred to as "start key"), the outlet motor 21 is driven in a normal direction. Then, the pinion 23 coupled with the shaft 22 of the outlet motor 21 is revolved and the rack 25 engaged therewith is moved downward, so that the outlet door 13 coupled with the rack 25 descends to open the outlet 7.

At this time, if a door open/close detecting sensor attached at a location above or below the outlet 7 detects a complete opening of the outlet 7, the outlet motor 21 stops and an indoor fan (not shown) is operated to suck the room air into the indoor unit 1 of the air conditioner through the inlet holes 3. And the air inhaled through inlet holes 3 passes through a heat exchanger (not shown) and is heat-exchanged by latent evaporative heat of coolant flowing in the heat exchanger.

The air heat exchanged in the heat-exchanger is guided upward and is discharged into the room through the outlet 7. The discharged air direction is controlled in accordance with angles of the horizontal blades 9 and vertical blades 11 to thereby accomplish the air-conditioning of the room.

A method of the prior art to vertically adjust a discharging direction of the air using the horizontal blades 9 is to twice manipulate an operational key equipped at the control panel 17 for operating the horizontal blades 9 to an front position. That is, if the key is manipulated one time at its on-position, the wind direction motor 27 is driven and the plurality of link members 29 swing the horizontal blades 9. And when the operational key is manipulated once again at its on-position, it turns off the wind direction motor 27 and stops the horizontal blades 9.

If a user turns off the operational key during the normal operation of the air conditioner as above, the outlet motor 21 is driven reversely. Then the pinion 23 is operated to move the rack 25 upward to thereby elevate the outlet door 13 and close the outlet 7.

However, there is a problem in the air conditioner manipulated by the method as described above, in that driving elements such as a compressor, indoor fan and the like are always driven by ON or OFF manipulation of the operational key. Accordingly, if the operational key is frequently manipulated by a user's mistakes or children's trifles, it constitutes one of the reasons for generating noises and reducing the life of driving elements and the apparatus as well.

Accordingly, it is an object of the present invention to provide an operational control apparatus of home appliances and control method therefor which can prevent intermittent operation of driving elements according to frequent on/off manipulations to thereby reduce noises and prolong the life of an air conditioner and driven elements at the same time.

SUMMARY OF THE INVENTION

The above and other objects are achieved by an operational control apparatus of home appliances according to the present invention, the apparatus comprising:

operation manipulating means for inputting start and stop signals to run drive elements according to the operational condition established by a user; and control means for controlling the drive of the driving elements by counting a time duration when a start or stop signal is being input by the operation manipulating means.

The operational control method of home appliances according to the present invention comprises the steps of:

identifying whether a start or stop signal is input from operational manipulating means;

determining whether a signal input duration has passed a predetermined time duration by counting a signal input duration when the start or stop signal is input; and running driving elements to operate home appliances in normal condition.

BRIEF DESCRIPTION OF THE DRAWINGS

For a fuller understanding of the nature and objects of the invention, reference should be made to the following detailed description taken in conjunction with the accompanying drawings in which.

DESCRIPTION OF THE PREFERRED EMBODIMENT

Figure 1:
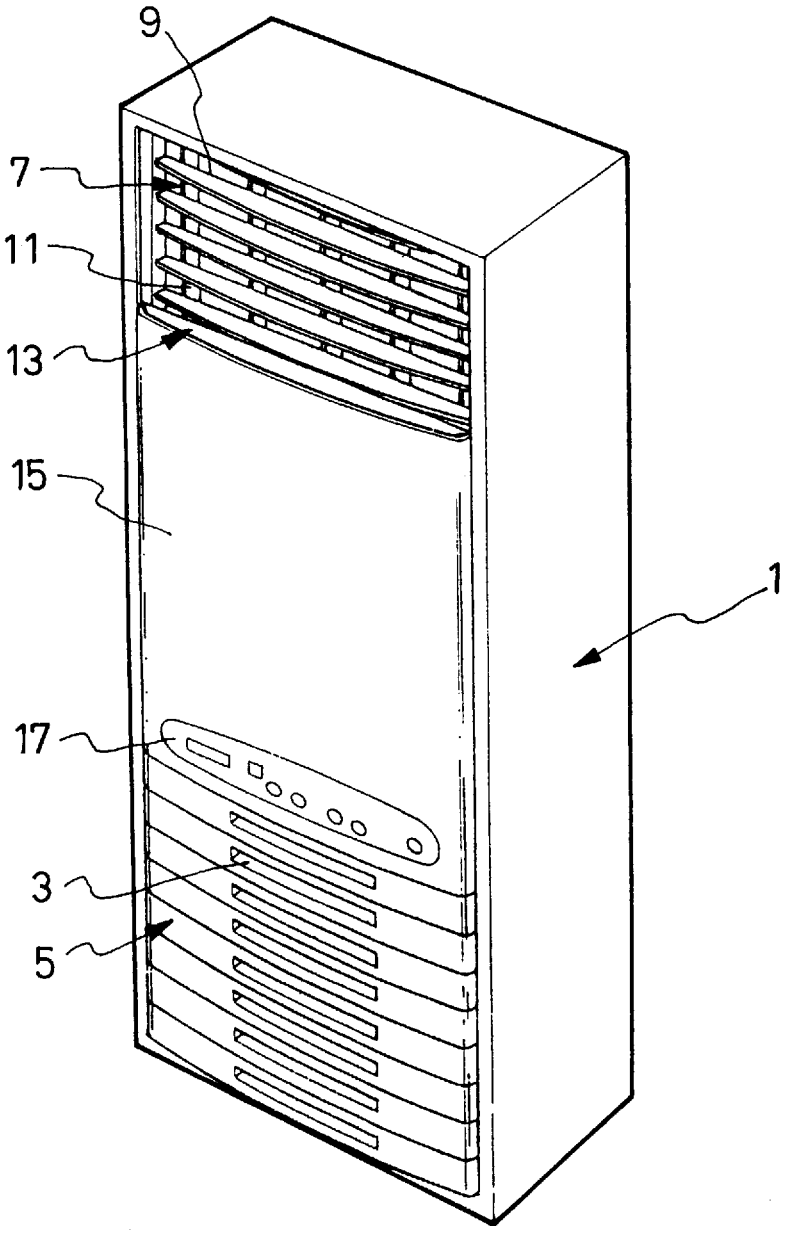
FIG. 1 (PRIOR ART)
FIG. 1 is a perspective view showing an air conditioner according to the prior art where an outlet is open.
Figure 2:
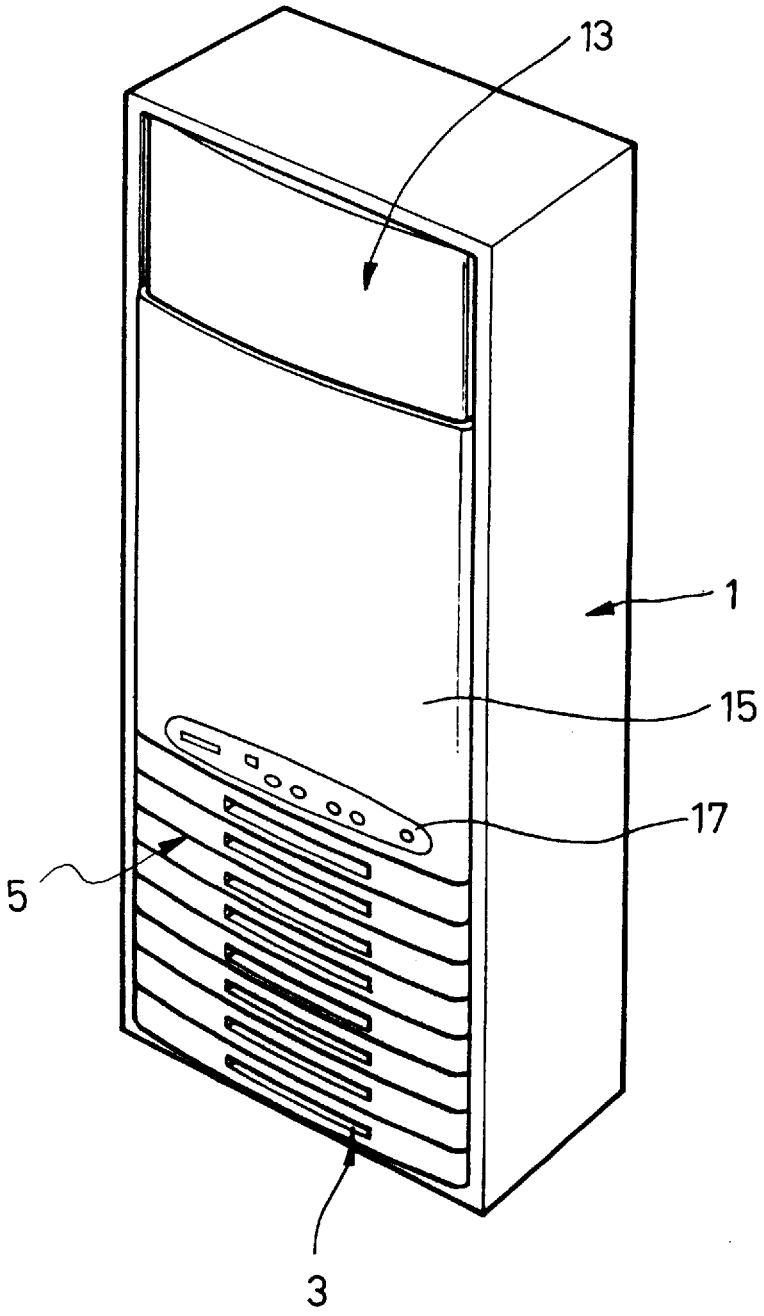
FIG. 2 (PRIOR ART)
FIG. 2 is a perspective view showing an air conditioner according to the prior art where the outlet is closed.
Figure 3:
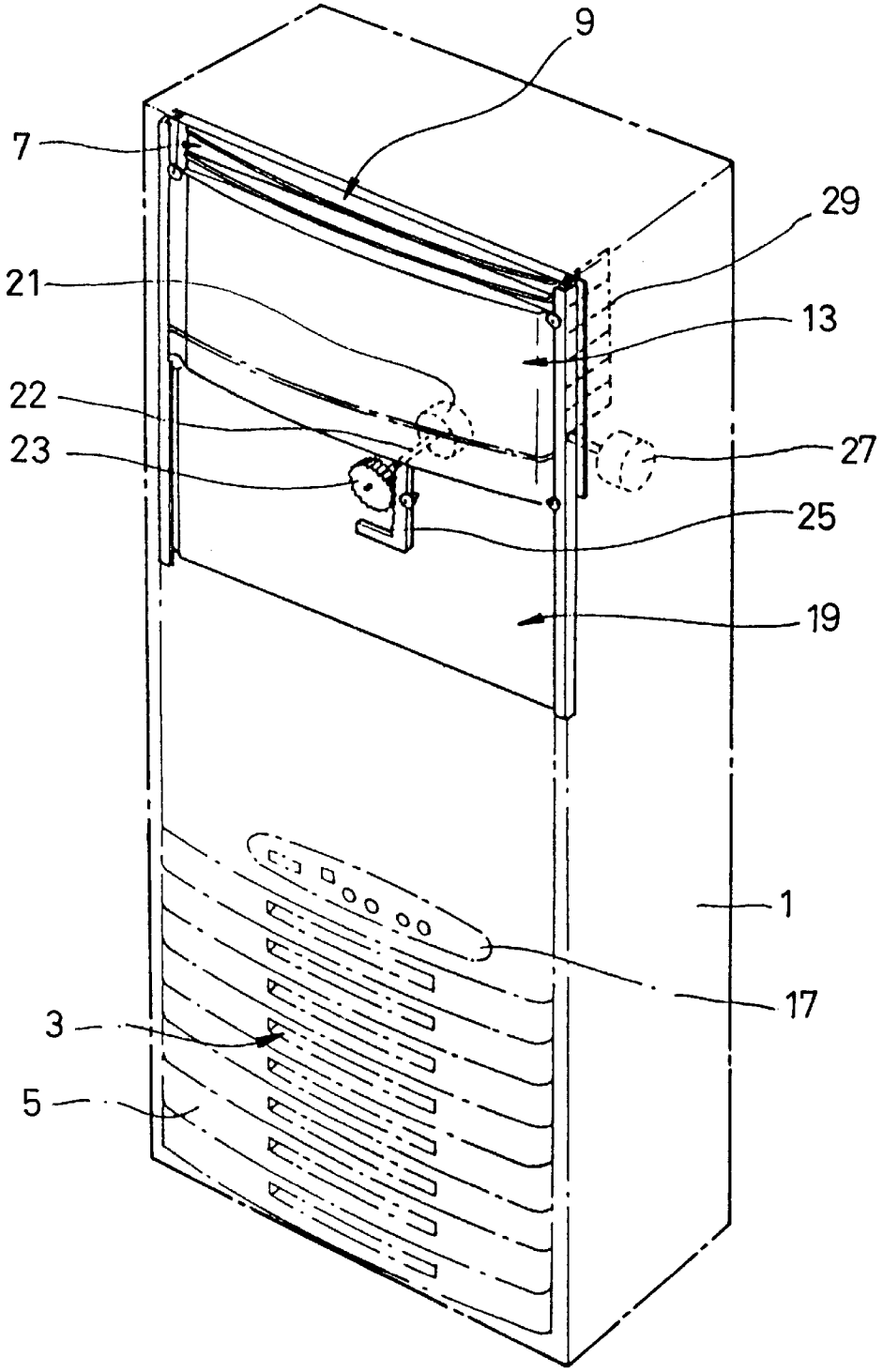
FIG. 3 (PRIOR ART)
FIG. 3 is a perspective view schematically showing an inner construction of an air conditioner according to the prior art.

A preferred embodiment of the present invention will now be described in detail with reference to the accompanying drawings.

Throughout the drawings, like reference numerals are used for designating like elements or parts similar to those of the air conditioner of the prior art and the repeated description thereof will be omitted for simplicity of illustration and explanation.

Figure 4:
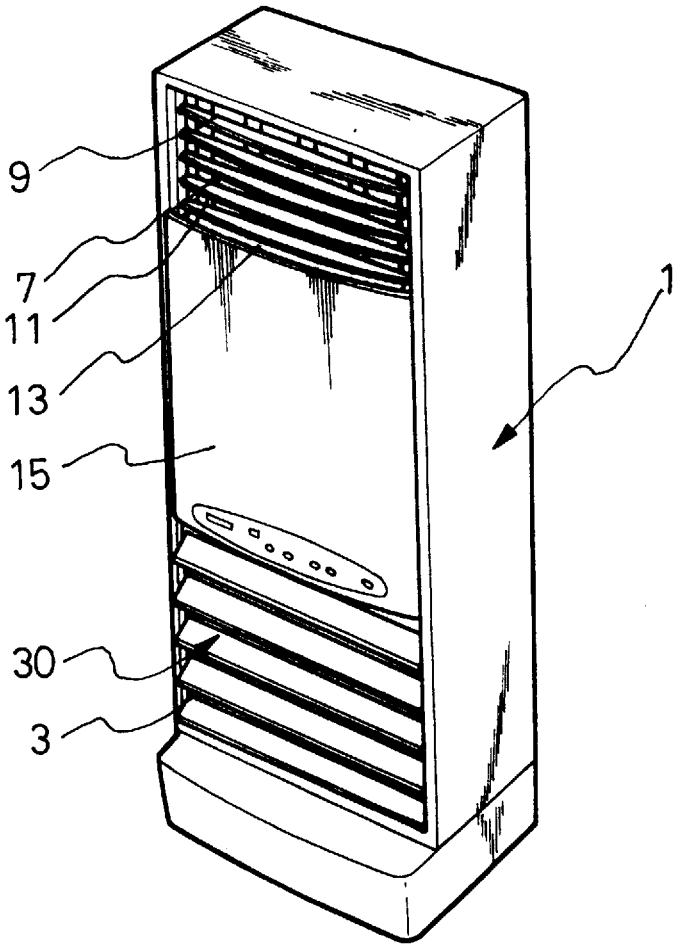
FIG. 4 is a perspective view showing an air conditioner according to an embodiment of the present invention.

As shown in FIG. 4, inlet open/close means 30 is installed at an inlet 3 formed at a lower part of an indoor unit 1 to open the inlet 3 so that the room air can be inhaled smoothly through the inlet 3, and to close the inlet 3 so that dust and harmful materials can be prevented from entering the indoor unit 1 and at the same time to provide an aesthetic appearance while the air conditioner is in a stand-by condition (not operated).

Figure 5:
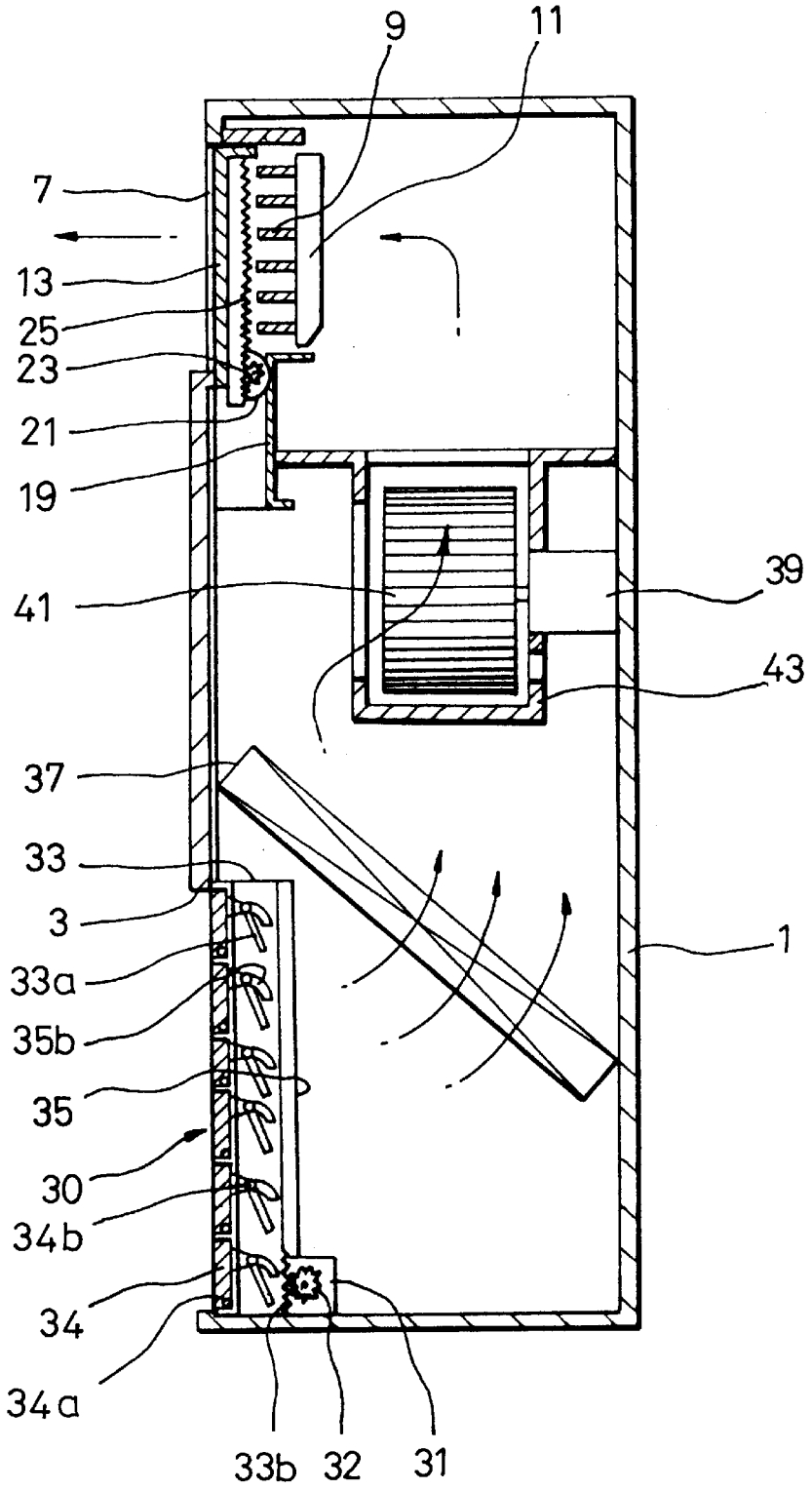
FIG. 5 is a cross sectional view showing an air conditioner according to the embodiment of the present invention where an inlet and an outlet are closed.

As shown in FIG. 5, the inlet open/close means 30 comprises an inlet motor 31 for generating a driving torque for opening or closing the inlet 3; a pinion for being rotated forward or backward by the inlet motor 31, a slide member 33 engaged with the pinion 32 and moving upward or downward according to a rotational orientation of the pinion 32; an inlet grill 34 linked with the slide member 33 and rotated according to translational movement of the slide member 33; and guide members 35 installed at both side ends of the inlet grill 34 for rotatably supporting the inlet grill 34 and at the same time for guiding the inlet grill 34 when opened or closed.

A heat exchanger 37 is installed downstream of the inlet open/close means 30 in order to heat-exchange the room air inhaled through the inlet 3, and a fan 41 driven by an indoor fan motor 39 (hereinafter referred to as "indoor fan") is installed over the heat exchanger 37 for inhaling the room air through the inlet 3 and at the same time for discharging the air to the room through the outlet 7.

Further, a duct 43 is installed around the indoor fan 41 in order to cover the indoor fan 41 and at the same time to guide the air flow through the outlet 7.

Figure 6:
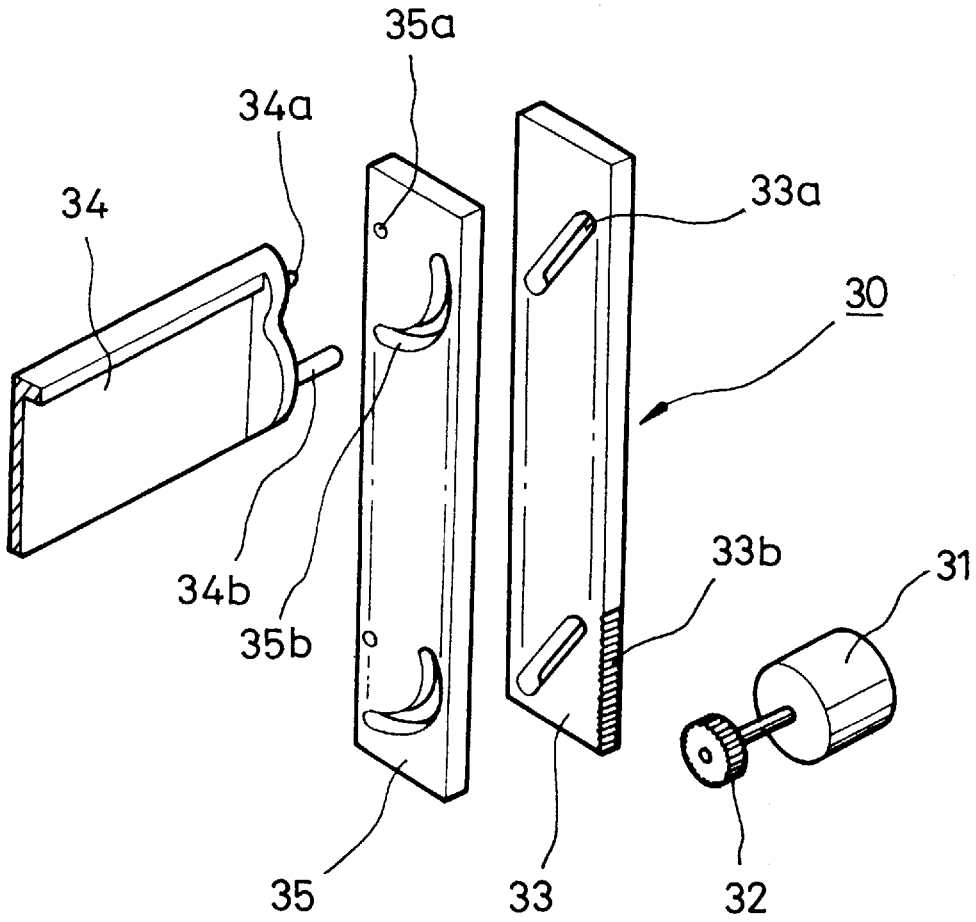
FIG. 6 is a perspective exploded view showing principal elements according to the present invention.

As shown in FIG. 6, hinge shafts 34*a* for supporting the inlet grill 34 to revolve freely are installed at both side ends of the inlet grill 34, and protrusions 34*b* formed at a side of the hinge shaft 34*a* are rotated by a groove 33*a* formed at a side of the slide member 33.

In addition, a fixing hole 35*a* to retain the hinge shafts 34*a* for freely revolving is formed at a side of a guide member 35, and an arch-shaped guide hole 35*b* is formed adjacent the fixing hole 35*a* so that the protrusions 34*b* rotate in accordance with the translational movement of the slide member 33, and a gear part 33*b* is formed at the side of the slide member 33 to be engaged with the pinion 32.

An electric circuit to control an open/close operation of the outlet door 13 and a vertical movement of the horizontal blades 9 in the air conditioner structured as above will be explained with reference to FIGS. 7 and 8.

Figure 7:
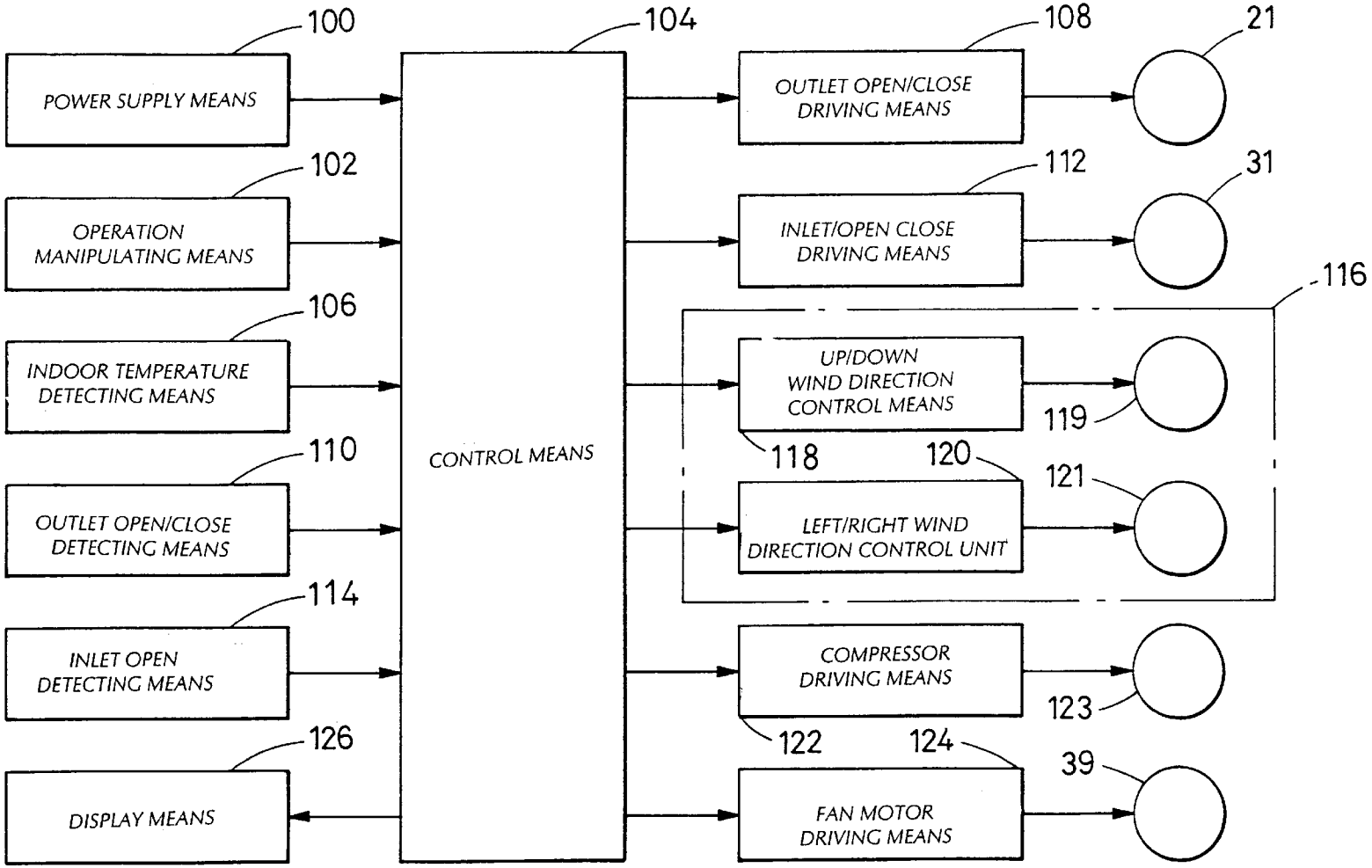
FIG. 7 is a control block diagram of an operational control apparatus according to the embodiment of the present invention.
Figure 8:
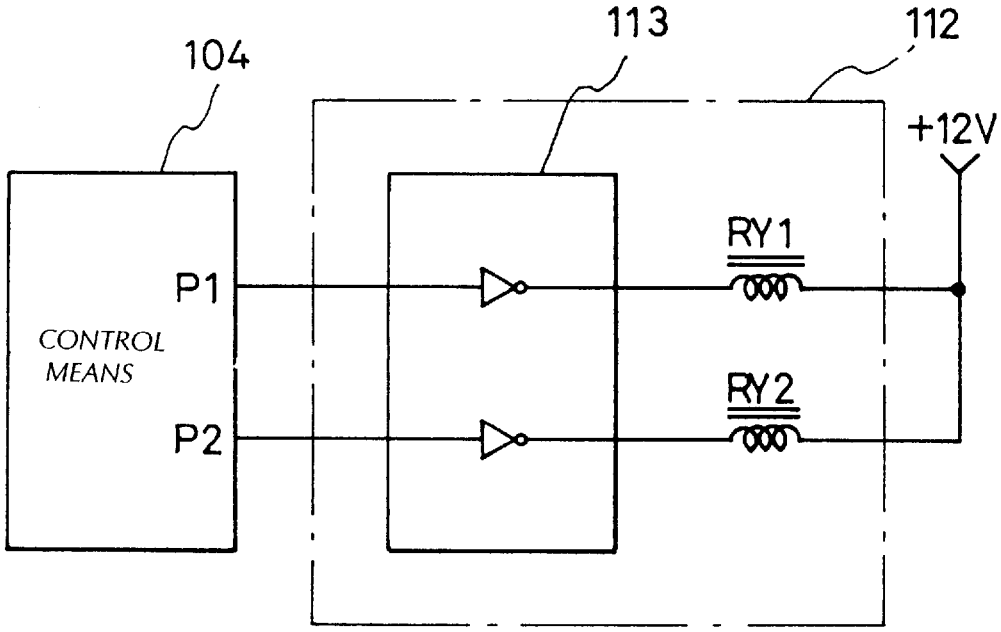
FIGS. 8 and 8A show an electric circuit of inlet open/close driving means according to the present invention.
Figure 8A:
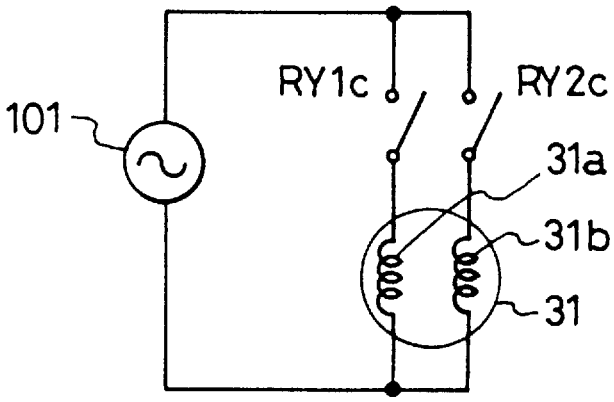
Figure 9A:
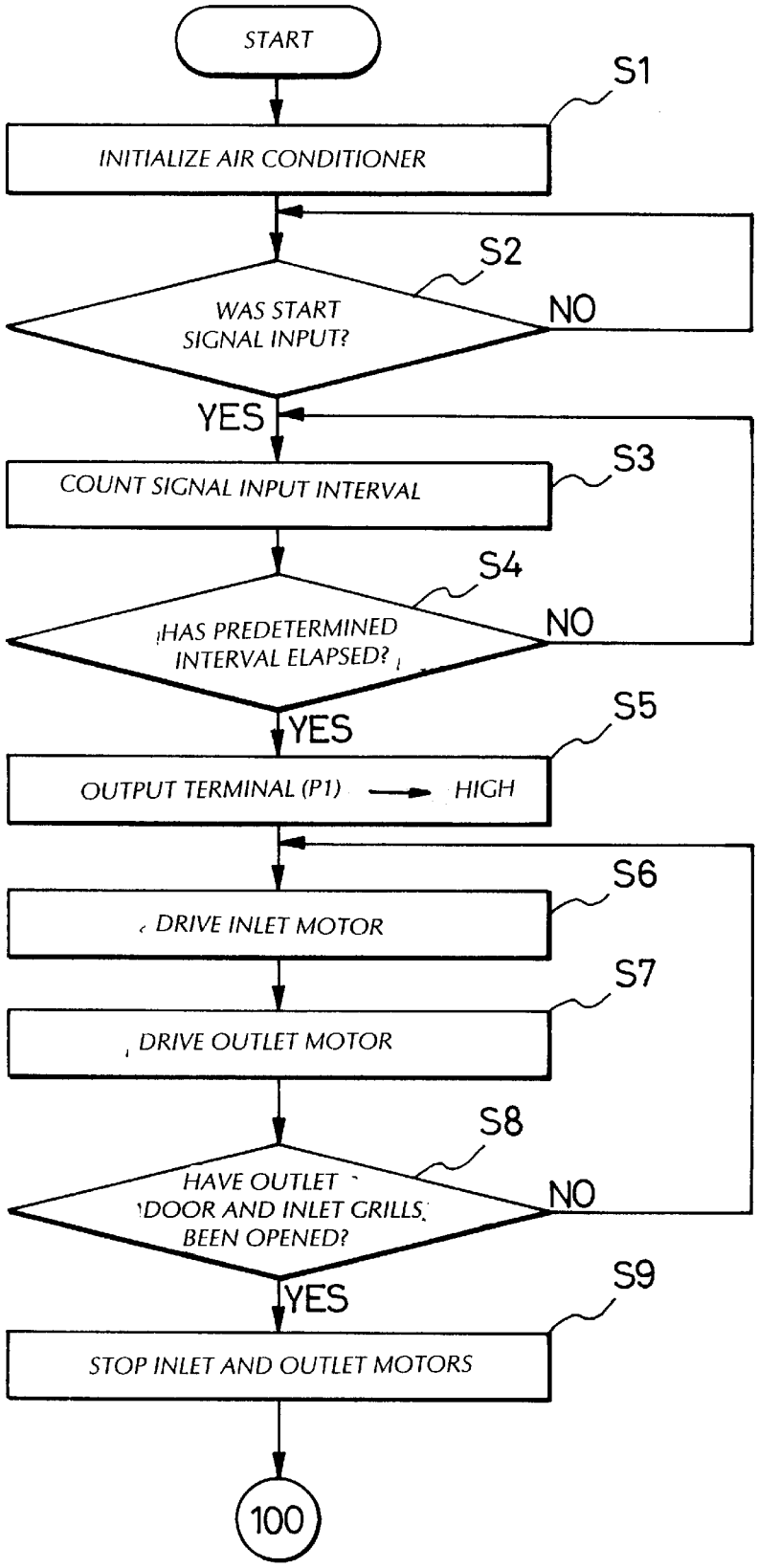
FIG. 9A to 9C are flow charts respectively showing operational sequences of an air conditioner according to the present invention.
Figure 9B:
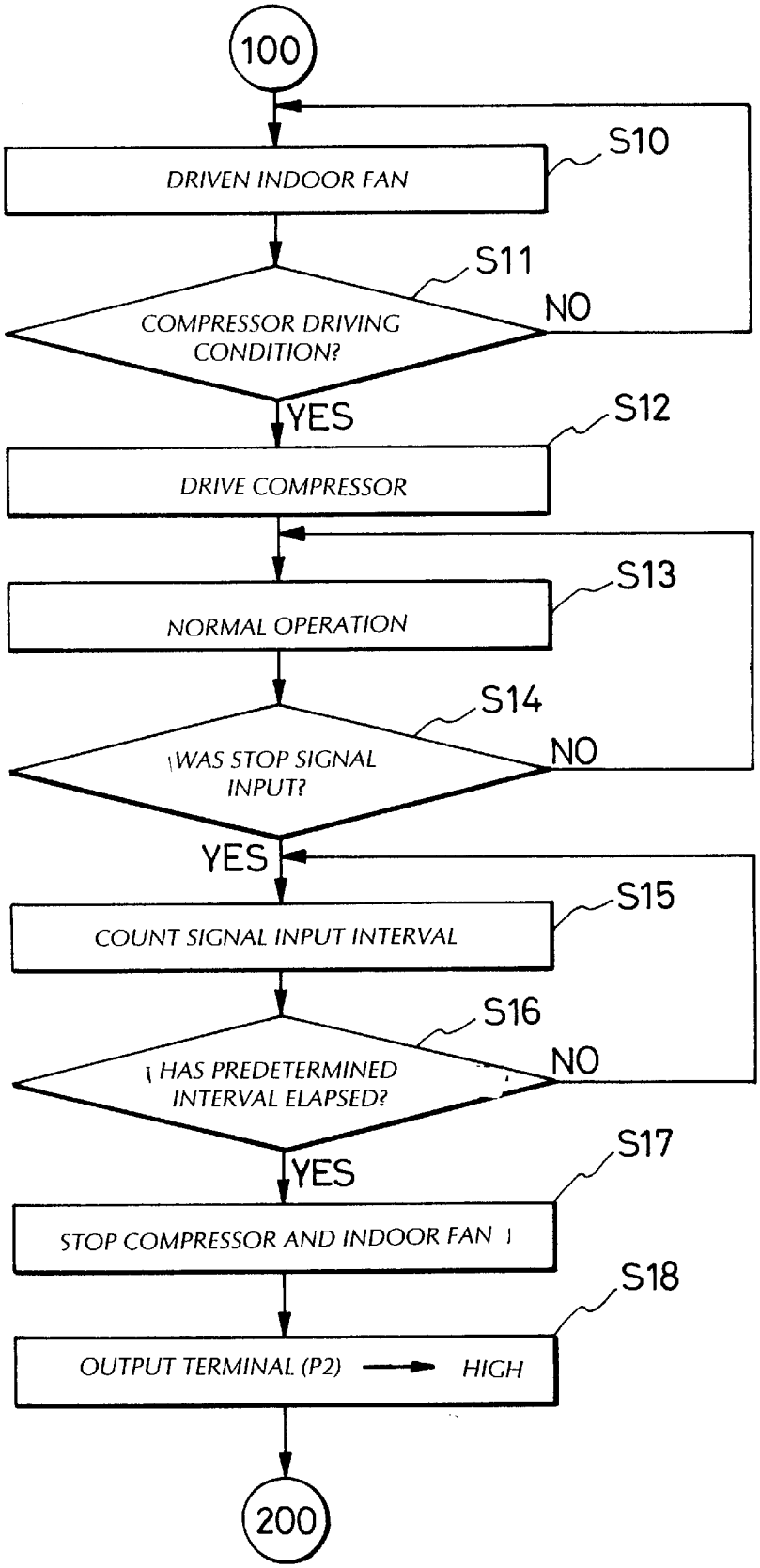
Figure 9C:
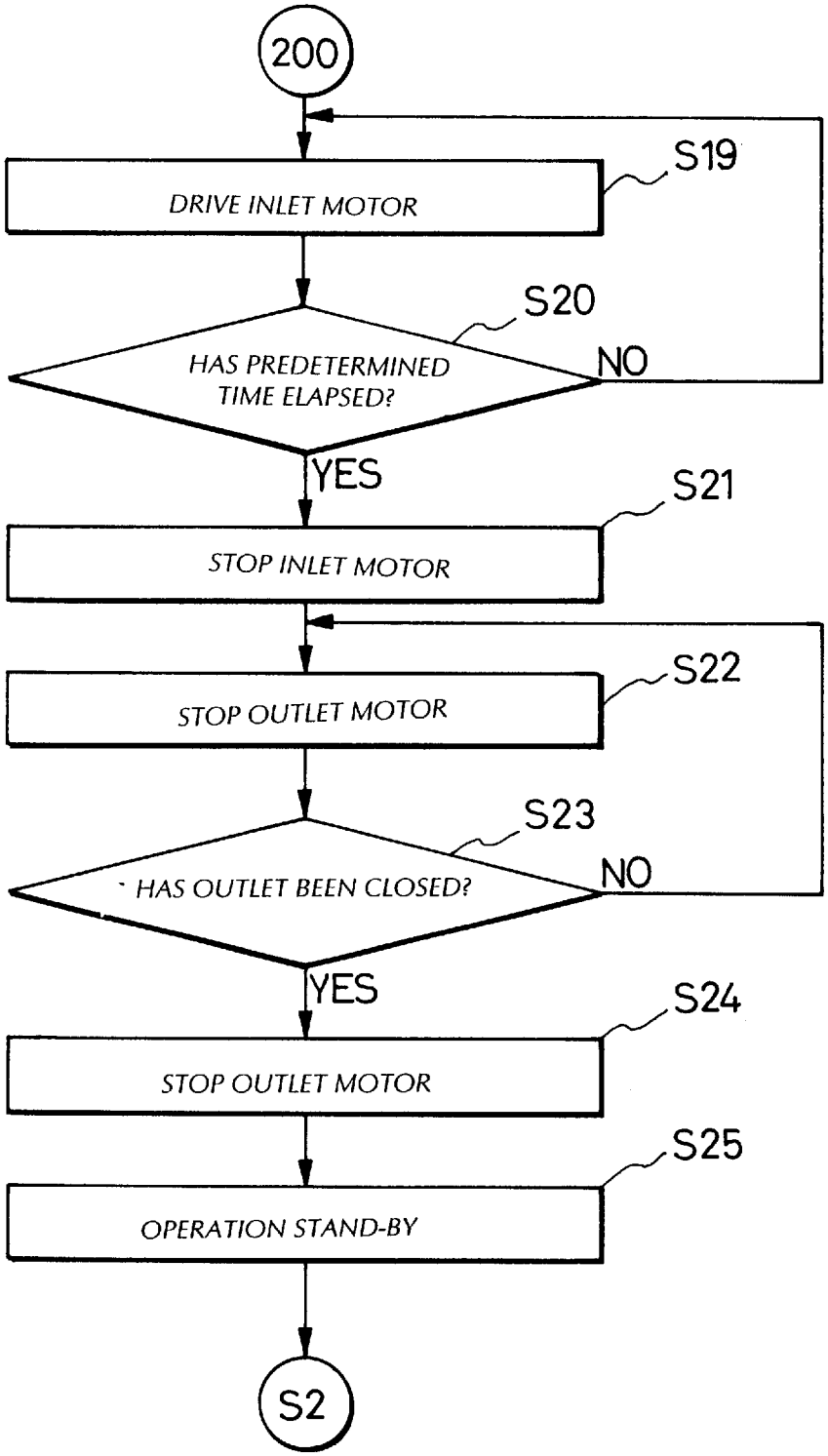

As shown FIGS. 7, 8 and 8A, a power supply means 100 serves to transform commercial A.C. voltage supplied from an A.C. power source 101 to a predetermined D.C. voltage necessary for operating the air conditioner to output the same. Operation manipulating means 102 is equipped with a start/stop key (hereinafter referred to as "start key") as well as a plurality of function keys for selecting drive modes (auto, cooling, defrosting, air blowing, heating or the like), wind amount of air discharged through the outlet 7 (strong wind, weak wind, breeze and the like) and desired temperature (Ts: hereinafter referred to as "established temperature").

A control means 104 is a microcomputer for initializing an operational condition of the air conditioner by receiving the D.C. voltage output from the power source 100 and controlling an overall operation of the air conditioner according to a selection signal input to the operation manipulating means 102. The control means 104 serves to control D.C. current applied to the inlet motor 31 for opening or closing the outlet door 13 and for opening or closing the inlet grill 34, and, at the same time, to count a grill close-driving time duration of the inlet motor 31 to control a close operation of the inlet grill 34.

Indoor temperature detecting means 106 detects an indoor temperature (Tr) from the room air being inhaled through the inlet 3 in order to conform the indoor temperature to an established temperature (Ts) by causing the air conditioner to accomplish the air conditioning. An outlet open/close driving means 108 receives a start,/stop signal output from the control means 104 when an operation start or stop signal is input, and controls the driving of the outlet motor 21 to vertically move the outlet door 13.

Further, outlet open/close detecting means 110 discriminates whether the outlet 7 is opened or closed according to an open/close position of the outlet door 13 which is vertically moving according to operation of the outlet open/close driving means 108, and outputs the detected signal to the control means 104.

Inlet open/close drive means 112 receives a control signal output from the control means 104 when the operation start signal or the operation stop signal is input by the operation manipulating means 102 and also controls the driving of the inlet motor 31 in order to move the inlet grill 34 for opening and closing the inlet 3. The inlet open/close drive means 112 comprises an inverter IC 113 for reversing an open/close control signal of high level output from output terminals P1 and P2 of the control means 104, a relay RY1 being turned on by D.C. voltage (12V) output from the power supply means 100 in order to drive the inlet motor 31 forwardly when a door open control signal of low level reversed by the inverter IC 113 is output, and a relay RY2 being turned on by D.C. voltage (12V) output from the power supply means 100 in order to reversely drive the inlet motor 31 when a door close control signal of low level reversed by the inverter IC 113 is output.

Inlet open detecting means 114 detects whether the inlet 3 has been opened by the inlet grill 34 according to a position of the slide member 33 which moves upward in accordance with the driving of the inlet motor 31, and the inlet open detecting means 114 outputs a corresponding signal to the control means 104.

Further, wind direction control means 116 serves to control a wind direction of the air discharged through the outlet 7 vertically and horizontally so that the wind is spread all over the room. The wind direction control means 116 comprises an up/down wind direction control unit 118 for receiving control signal output from the control means 104 and driving an up/down wind direction motor 119 so that the horizontal blades 9 move up and down; and a left/right wind direction control unit 120 for receiving a control signal output from the control means 104 and driving a left/right wind direction motor 121 so that the vertical blades 9 move left and right.

Compressor driving means 121 receives control signal output from the control means 104 according to a difference between an established temperature (Ts) input by user and a room temperature (Tr) detected by the indoor temperature detecting means 106, and controls the driving of the compressor 123. Fan motor driving means 124 receives control signal output from the control means 104 to ventilate the air heat exchanged in the heat exchanger 37 to the room, and controls the R.P.M. of the indoor fan motor 39 to run the indoor fan 41.

In the accompanying drawings, display means 126 displays an operational condition of the air conditioner as well as an operational selection mode (auto, cooling, defrosting, air blowing, heating or the like), an established temperature (Ts) and a current room temperature (Tr).

The operations and effects regarding the operational control apparatus of the air conditioner described as above and method therefor will be explained.

FIGS. 9A to 9E are flow charts showing operational sequences of operational control of the air conditioner according to the present invention, and the letter S in FIGS. 9A to 9E indicates each "step".

An inlet 3 and an outlet 7 are assumed to be closed in the initial condition for explaining the operations of the air conditioner according to the present invention.

First, when power is applied to the air conditioner, a power supply means 100 transforms the commercial A.C. voltage supplied from a commercial A.C. power source 101 to a predetermined D.C. voltage necessary for driving the air conditioner and outputs it to both the driving circuit and the control means 104.

Accordingly, at step S1, the control means 104 receives the D.C. voltage from the power supply means 100 and initializes an operational condition of the air conditioner.

At this time, when a user manipulates the operation manipulating means 102 to input a desired operational mode (auto, cooling, defrosting, air blowing, heating or the like) of the air conditioner and a established temperature (Ts) and then presses the start key, the operation manipulating means 102 inputs an operational selection signal and an operation start signal (hereinafter, referred to as "operation signal") to the control means 104.

As the result, at step S2, the control means determines whether the operation signal is input from the operation manipulating means 102 or not. If the operation signal is not input (in case of "No"), the control means 104 maintains the air conditioner in an operation stand-by condition and repeats the steps S1 and S2.

If the operation signal is input (in case of "Yes") at step S2, the control means 104 proceeds to the step S3 and counts a time interval during which the operation signal is present, by a timer installed therein.

At this time, at step S4, the control means 104 determines whether the counted time interval has passed a predetermined time (the minimal time interval for preventing frequent ON/OFF operations of the driving elements, e.g., about 3 seconds). If the counted time has not passed a predetermined time(in case of "NO"), it returns to the step S3 and repeats the foregoing steps 1 to 3.

If the counted time duration has passed a predetermined time duration (in case of "Yes") at step S4, and the operation signal is still present, the control means determines that the operation signal has been input normally and proceeds to step S5 at which the control means 104 outputs a control signal of high level through an output terminal P1 to the inlet open/close driving means 112 in order to open the closed inlet 3.

Accordingly, the open control signal of high level output from the output terminal Pi of the control means 104 is inverted to that of low level through an inverter IC 113, and a relay RY1 is turned on by D.C. voltage (b 12V) output from power supply means 100 so that contact points RY1c of the relay RY1 are closed.

If the contact points RY1c of the relay RY1 are closed, the A.C. voltage, at step S6, is applied from the A.C. current supply terminals 101 to coil 31*a* of the inlet motor 31 to run the inlet motor 31 in forward direction. The pinion 32 coupled with the shaft of the inlet motor 31 is revolved, and the slide member 33 engaged with a side of the pinion 32 ascends. As the slide member 33 ascends, the groove 33*a* is moved upward. Further, as the groove 33*a* ascends, the protrusions 34*b* of the inlet grill 34 are rotated while being guided by the arc shaped guide hole 35*b*, so that the inlet grill 34 is rotated by a determined angle to open the inlet 3.

And, at step S7, the control means 104 outputs a control signal for opening the closed outlet 7 to the outlet open/close driving means 108.

Accordingly, the outlet open/close driving means 108 drives the outlet motor 21 according to the control of the control means 104, so that the outlet motor 21 is driven forwardly and the pinion 23 coupled with the shaft 22 of the outlet motor 21 is revolved to move the rack 25 coupled therewith downward to thereby lower the outlet door 13 coupled with the rack 25 to open the outlet 7.

At this time, at step S8, an outlet open/close detecting means 110 detects a descending position of the outlet door 13, and an inlet open detecting means 114 detects an ascending position of the slide member 33 which is moved upward by the driving of the inlet motor 31.

Accordingly, the control means 104 receives signals detected by the outlet open/close detecting means 110 and the inlet open detecting means 114, and determines whether the outlet door 13 and the inlet grill 34 are opened or not. If the outlet door 13 and the inlet grill 34 are not opened(in case of "NO"), operation returns to step S9 and continues to drive the outlet motor 21 and the inlet motor 31 till the outlet door 13 and the inlet grill 34 are opened.

If the outlet door 13 and the inlet grill 34 are opened(in case of "YES") at step S8, operation proceeds to step S9 at which the outlet open/close drive means 108 stops driving the outlet motor 21 according to the control of the control means 104 to conclude the opening operation of the outlet door 13.

And the inlet open/close drive means 112 stops driving the inlet motor 31 according to the open control signal of low level output from the output terminals P1 of the control means 104 to conclude the opening operation of the inlet grill 34.

Then, at step S10, the fan motor driving means 124 drives the indoor fan 41 by controlling the R.P.M. of the indoor fan motor 39 according to the control of the control means 104.

If the indoor fan 41 is driven, room air starts to be inhaled into the indoor unit 1 through the inlet 3. At this time, the indoor temperature detecting means 106 detects the indoor temperature (Tr) from the incoming air inhaled through the inlet 3.

Meanwhile, at step S11, the indoor temperature (Tr) detected by the indoor temperature detecting means 106 is compared to the established temperature (Ts) set in the operation manipulating means 102 by the user and determines whether the compressor 123 should be driven.

The compressor 123 should be driven if the indoor temperature (Tr) detected by the indoor temperature detecting means 106 is higher than the established temperature (Ts) set by the user in an air-cooling operation, or if the indoor temperature (Tr) detected by the indoor temperature detecting means 106 is lower than the established temperature (Ts) set by the user in an air-warming operation.

If the compressor 123 should not be driven (in case of "NO") at step S11, operation returns to step S10 and repeats steps S1 to S10 while detecting the indoor temperature (Tr). If the compressor 123 should be driven (in case of "YES"), operation proceeds to step S12 at which the control means 104 determines a driving frequency of the compressor 123 according to a difference between the indoor temperature (Tr) and the established temperature (Ts) and outputs the control signal for driving the compressor 123 to the compressor driving means 122.

Accordingly, the compressor driving means 122 drives the compressor 123 at a driving frequency determined by the control means 104.

If the compressor 123 is driven, the indoor fan 41 is driven at the step S13 and the room air is inhaled into the indoor unit 1 through the inlet 3 and is heated or cooled while passing through the heat exchanger 37 by latent evaporative heat of coolant flowing in the heat exchanger 37.

The air of cold wind or hot wind heat exchanged in the heat exchanger 37 is moved upward and is discharged to the room in a direction controlled by the wind direction angles of the horizontal blades 9 and the vertical blades 11.

The controller determines whether the operation key of the drive manipulation means 102 becomes turned off and whether the operation stop signal is input, at step S14, while the air conditioner is in normal operation as above. If the operation stop signal is not input (in case of "NO"), operation returns to step S13 and repeats steps S1 to S13 while accomplishing normal operation.

If the operation stop signal is input(in case of "YES") at step S14, operation proceeds to step S15 at which the control means 104 counts the signal input interval.

At this time, at the step S16, it is determined whether the signal input interval counted by the control means 104 has passed the predetermined time interval (about 3 seconds). If the predetermined time interval has not been elapsed(in case of "NO"), operation returns to step S15 and repeats steps S1 to S15 till the predetermined time interval has elapsed.

If the determined time interval has elapsed (in case of "YES") at step S16, and the stop signal is still present, it is determined that the operation stop signal has been input normally and operation proceeds to step S17, so that the control means 104 outputs the control signal for stopping the compressor 123 and the indoor fan motor 39.

Next, at step S18, the control means 104 outputs a control signal of high level through an output terminal P2 to the inlet open/close driving means 112 in order to close the opened inlet 3.

Accordingly, the control signal of high level output from the output terminal P2 of the control means 104 is inverted to low level through the inverter IC 113, and the relay RY2 is turned on by D.C. voltage (12V) output from power supply means 100 so that contact points RY2c of the relay RY2 become closed.

If the contact points RY2c of the relay RY2 are closed, the A.C. voltage from A.C. supply terminals 101 is applied to coil 31*b* of the inlet motor 31 to drive the inlet motor 31 in reverse direction at step S19. Then, the pinion 32 coupled with the shaft of the inlet motor 31 is revolved reversely, the slide member 33 engaged with a side of the pinion 32 descends and the groove 33*a* moves downward as the slide member 33 is descending. As the groove 33*a* is descending, the protrusions 34*b* of the inlet grill 34 are rotated while being guided by the arc shaped guide hole 35*b*, so that the inlet grill 34 is rotated by a predetermined angle to close the inlet 3.

At this time, the control means 104 counts, at step S20, the close time duration of the inlet motor 31 and determines whether a predetermined time duration (data produced through experiments for the time necessary for closing the inlet grill, about 11.5 seconds) has elapsed. If the predetermined time duration has not elapsed (in case of "NO"), operation returns to the step S33 and continues to drive the inlet motor 31 till the inlet grill 34 becomes closed.

If the predetermined time duration has elapsed (in case of "YES") at the step S20, it is determined that the inlet grill 34 is completely closed and operation proceeds to step S21 at which the inlet open/close driving means 112 stops driving the inlet motor 31 to conclude the closing operation of the inlet grill 34.

Then, at step S22, the control means 104 outputs a control signal for closing the opened outlet 7.

Accordingly, the outlet open/close driving means 108 drives the outlet motor 21 according to the control of the control means 104. The outlet motor 21 is driven reversely and the pinion 23 coupled with the shaft 22 of the outlet motor 21 is revolved to upward move the rack 25 coupled therewith to thereby raise the outlet door 13 coupled with the rack 25 to close the outlet 7.

At this time, at step S23, an outlet open/close detecting means 110 detects the position of the outlet door 13 which is moved upward by the outlet motor 21 and, the control means 104 receives the signal detected by the outlet open/close detecting means 110 to determine whether the outlet door 13 is closed or not.

If the outlet door 13 and the inlet grill 34 are not closed (in case of "NO") at step S23, operation returns to step S22 and continues to drive the outlet motor 21 till the outlet door 13 is completely closed. If the outlet door 13 is closed(in case of "NO"), operation proceeds to step S24 at which the outlet open/close drive means 108 stops driving the outlet motor 21 according to the control of the control means 104 to conclude the closing operation of the outlet door 13.

The operation of the inlet motor 31 in the steps S19–S21 and the operation of the outlet motor 21 in the steps S22–S24 are accomplished simultaneously, but have been described in sequence for explanation convenience only.

In succession, at step S25, the control means 104 returns to step S2 and repeats steps S1 and S2 while maintaining an operational stand-by condition till the operation signal is input again by the operation manipulating means 102.

As described as above, the operational control apparatus for home appliances and a control method therefor according to the present invention prevent driving elements from being intermittently operated according to frequent ON/OFF manipulations to thereby reduce noise generation and prolong the life of driving elements and the product as well.

What is claimed is:

1. A home appliance comprising:

a drive element;

a controller connected to the drive element for supplying a drive signal thereto;

a manually actuable input panel connected to the controller for supplying an input signal for selectively driving and stopping the drive element; and a counter connected to the controller and input panel for counting a time following each manual input of the input signal for delaying a driving and stopping, respectively, of the drive element for a predetermined time period.

2. A method of operating a home appliance having a drive element, a controller for controlling a driving of the drive element and a manual input panel connected to the controller for enabling a user to supply an input signal for selectively driving and stopping the drive element, the method comprising:

counting a time interval following each manual input of the input signal; and selectively driving and stopping the drive element if no counter signal is input within a predetermined time interval.

3. The method according to claim 2 wherein the predetermined time interval is from 1 to 10 seconds.

* * * * *